United States Patent [19]

Marko

[11] Patent Number: 4,849,765

[45] Date of Patent: Jul. 18, 1989

[54] LOW-PROFILE, PRINTED CIRCUIT BOARD ANTENNA

[75] Inventor: Paul D. Marko, Pembroke Pines, Fla.

[73] Assignee: Motorola, Inc., Schaumburg, Ill.

[21] Appl. No.: 189,092

[22] Filed: May 2, 1988

[51] Int. Cl.[4] ..... H01Q 1/24; H01Q 1/48

[52] U.S. Cl. ..... 343/702; 343/700 MS; 343/834; 343/846

[58] Field of Search ..... 343/700 MS File, 702, 343/824, 825, 829, 830, 814–819, 834, 847, 848, 846; 455/89, 90

[56] References Cited

U.S. PATENT DOCUMENTS

| | | | |
|---|---|---|---|
| 3,808,600 | 4/1974 | Bourdier | 343/830 |
| 3,978,487 | 8/1976 | Kaloi | 333/328 |
| 4,291,312 | 9/1981 | Kaloi | 343/700 MS |
| 4,494,120 | 1/1985 | Garay | 343/702 |
| 4,584,585 | 4/1986 | Marko et al. | 343/702 |
| 4,628,322 | 12/1986 | Marko et al. | 343/702 |

FOREIGN PATENT DOCUMENTS

| | | | |
|---|---|---|---|
| 0075005 | 5/1982 | Japan | 343/700 MS |

*Primary Examiner*—Rolf Hille
*Assistant Examiner*—Doris J. Johnson
*Attorney, Agent, or Firm*—Donald B. Southard; Anthony J. Sarli, Jr.

[57] ABSTRACT

A low-profile antenna for operating in the 800 to 900 mHz range and especially suited for use with portable, hand-held electronic apparatus. The antenna features printed circuit board construction for precision fabrication, broadband operations and enhanced efficiency. The antenna includes a driven element in close association with a parasitic element printed on one surface of the printed circuit board in a side-by-side, parallel relation. A conductive strip is included on the other side of the board spanning the free ends of the driven and parasitic elements to enhance the coupling therebetween.

14 Claims, 2 Drawing Sheets

LOW-PROFILE, PRINTED CIRCUIT BOARD ANTENNA

BACKGROUND OF THE INVENTION

The present invention relates generally to antennas and more particularly to a low-profile antenna suitable for inclusion in a portable, hand-held communication device, which antenna is constructed on a printed circuit board for precision fabrication, broadband operation and enhanced efficiency.

It is well understood that two- way communication apparatus, whether fixed, mobile or portable, require associated antenna devices to send and receive messages and/or other intelligent information. For portable radio units, a frequent accommodation has been to provide an external whip antenna. These antennas extend upwardly or normal to the surface of the radio unit and are made flexible to avoid injury to the radio user. Unfortunately, such exterior whip antennas add significantly to the overall dimensions, which is particularly disadvantageous where compactness is a design criteria, and, in any event, such antennas are cumbersome, unwieldy and may be uncomfortable to the user when the radio unit is worn on the person.

One solution to the foregoing is to provide a low-profile antenna for the associated radio communication device. By low-profile, it is meant that the principal radiating element is positioned essentially parallel to one of the radio unit's surfaces instead of orthogonal thereto. In point of fact, there is usually a parasitic element provided in association with the driven or radiating element. Examples of these low-profile antenna configuration may be found in U.S. Pat. Nos. 4,494,120 and also 4,584,585. In the structures as disclosed in these patents, a radiating element is located in a parallel relation to a flat surface but spaced therefrom at a predetermined distance. In each case, a parasitic element is provided in association with the driven element. While these antennas meet an important objective, i.e., low-profile, compact design, there are some aspects of their operating characteristics that are somewhat less than desired. They are formed by rod elements which may not provide the extent of the bandwidth needed for a particular application. Moreover, because of the rod element construction, and because they are spaced by supports, usually at end locations, they are susceptible during their service life to being bent out of their desired shape, or otherwise damaged, which, of course, affects their overall operating performance. Again, because of the rod element construction, they are not easily constructed or at least positioned with the desired degree of precision during manufacturing. Any deviation from the theoretical spacings and/or locations give rise to less than optimum antenna performance.

What is needed then is a simple, two-element low-profile antenna that exhibits broad band operation and a high degree of efficiency and which, nevertheless, may be manufactured with precision and repeatability with respect to the desired operating characteristics.

SUMMARY OF THE INVENTION

Accordingly, it is an object of the present invention to provide a low-profile, two-element antenna configuration that avoids the use of rod element construction, has broad bandwidth, high efficiency in operation and good impedance characteristics.

A more particular object of the present invention is to provide a low-profile antenna of the type which is fabricated on a printed circuit board with close tolerances for precision and optimization regarding overall operating characteristics and ease of repeatability in manufacturing.

In practicing the invention, a low-profile antenna is provided which is capable of operation in a given frequency band and is especially suited or adapted for use with hand-held, portable electronic apparatus. The antenna includes a printed circuit board having a driven element and a parasitic element printed thereon in a side-by-side, parallel relation. The driven element preferably is a quarter wave or more at the lower band edge of the operating frequency range and the parasitic element is essentially a quarter wave at the upper band edge thereof. A feed point is included at one end of the driven element with a ground point at one end of the parasitic element adjacent the feed point end of the driven element. To enhance the coupling between the driven and parasitic elements, a conductive strip is printed on the other side of the printed circuit board and spanning the free ends thereof.

BRIEF DESCRIPTION OF THE DRAWINGS

The features of the present invention which are believed to be novel are set forth with particularity in the claims appended hereto. The invention, itself, however, together with further objects and advantages thereof, may be best understood by reference to the following drawings, in which:

BRIEF DESCRIPTION OF THE PREFERRED EMBODIMENT

Figure 1:
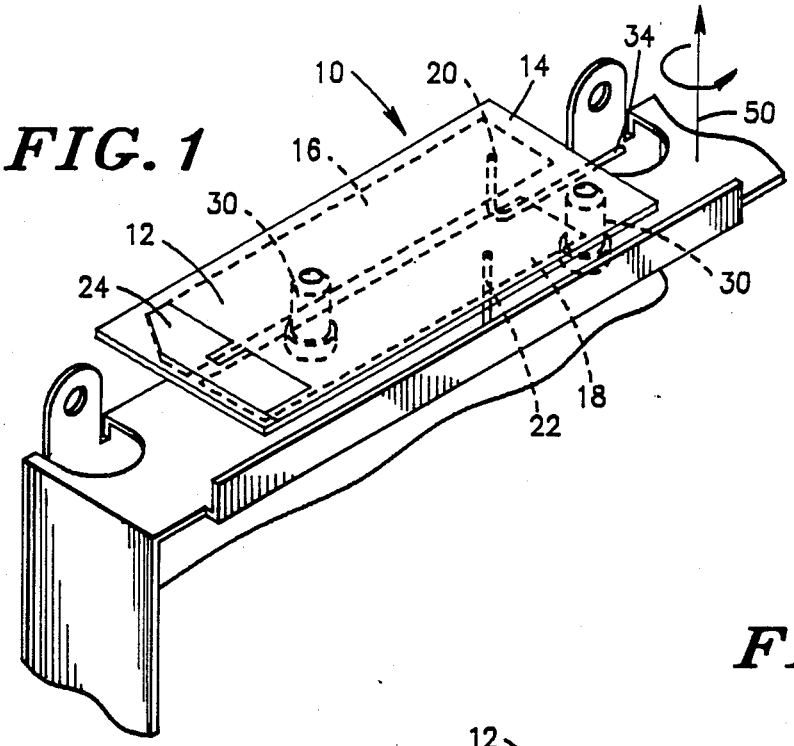
FIG. 1 is a view in perspective of a portion of an electronic chassis as part of a portable, hand-held device on which a low-profile antenna is mounted, which antenna has been constructed in accordance with the present invention.

Referring now to the drawings, a portion of an electronic chassis 10 is depicted on which a low-profile antenna 12 is mounted, which antenna has been constructed in accordance with the present invention. For purposes of the present invention, chassis 10 may be considered as suited for any hand-held portable electronic apparatus, but in the case at hand is in fact the chassis for a radio data terminal operating in the frequency range of 806 to 870 mHz.

Figure 3A:
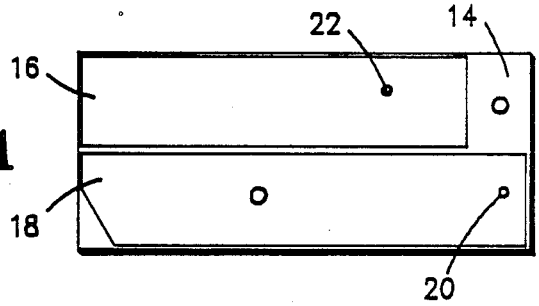
FIG. 3*a* and 3*b*, together are plan views in elevation of the respective sides of a printed circuit board with the conductive elements of the antenna printed thereon.
Figure 3B:
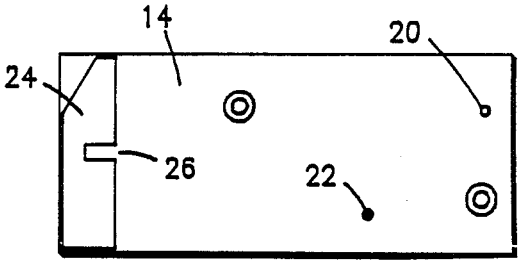

Antenna 12 includes a printed circuit board 14 on which a driven element 16 and a parasitic element 18 are printed of a suitable metallic or conductive material on one surface of board 14 in a side-by-side, parallel relation (best seen in FIG. 3*a* and 3*b*). As indicated, the driven element 16 is slightly greater in the longitudinal dimension than the parasitic element 18. Driven element 16 is intended to be a quarter wave or more at the lower band edge of the operating frequency band, i.e., 806–870 mHz, while the parasitic element 16 is essentially a quarter wave at the higher band edge. The broadband (in excess of 60 mHz) operation of the antenna is due in large measure to the significant surface area exhibited by the parasitic and driven elements, i.e., between 1.7 in.$^2$ and 2.0 in.$^2$, respectively. This, of course, is many times than that as could be presented by conventional rod element construction. As understood by those skilled in the art, the operating band of an antenna is essentially proportional to the surface area of the elements so forming the antenna, which surface area obviously plays an important, indeed critical, role in the design criteria of any antenna under consideration.

In terms of actual dimensions for the configuration as shown in FIGS. 3*a* and 3*b*, the printed circuit board is 3.04 inches overall; with the driven element being 3.0 inches in length and 0.646 inches in width. Parasitic element 18 is of the same width, but is 2.6 inches in length. The spacing between element 16 and 18 is approximately 0.02 inches or 20 mils.

The driven element 16 has a feed point 20 near one end at approximately 0.18 inches from the printed circuit board edge. The parasitic element 18 has a ground point 22 near its end adjacent the feed point 20 which is approximately 0.955 inches from the printed circuit board edge. It should be noted that these particularized dimensions have been adjusted to compensate for dielectric loading effects introduced by the plastic housing in which the antenna is to be contained.

On the reverse side of the printed circuit board 14, a strip of conductive material 24 is plated across the free ends of elements 16 and 18 and serves to enhance the coupling therebetween. The notch 26 in strip 24 is primarily to restrict coupling currents therein to the extreme ends of the driven and parasitic elements.

Figure 2:
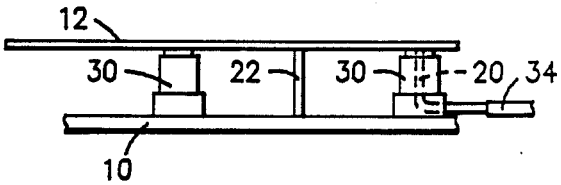
FIG. 2 is a view in elevation of the antenna of the present invention mounted on associated mounting posts with cable feed and ground connections included.

The antenna 12 is mounted on insulating mounting posts 30 as seen in side elevation in FIG. 2 and in dotted line in FIG. 1. These may be constructed of any suitable non-conducting material, such as a dielectric. The spacing of antenna 12 from the chassis 10 is on the order of 1/30th of a wave length. The ground wire 32 interconnects ground point 22 of the parasitic element 18 to the chassis. Antenna feed point 20 is coupled to a feed cable 34, as shown, with a characteristic impedance of approximately 50 ohms.

In this manner, a highly efficient antenna is provided which exhibits broadband operation and presents an extremely low-profile arrangement. Not only does the antenna have a low-profile, but it is also characterized by the close tolerances effected during manufacture for the constituent parts forming its overall structure. Both attributes are due to large measure to its unique printed circuit board construction. Driven and parasitic elements may be precisely dimensioned, as well as the spacings therebetween. This not only optimizes antenna performance, but also prevents any subsequent changes in their relative positions and dimensions, such as frequently encountered with rod elements as previously referenced. Moreover, with printed circuit board construction, the repeatability in fabricating like antennas with like performance is substantially guaranteed.

Figure 4:
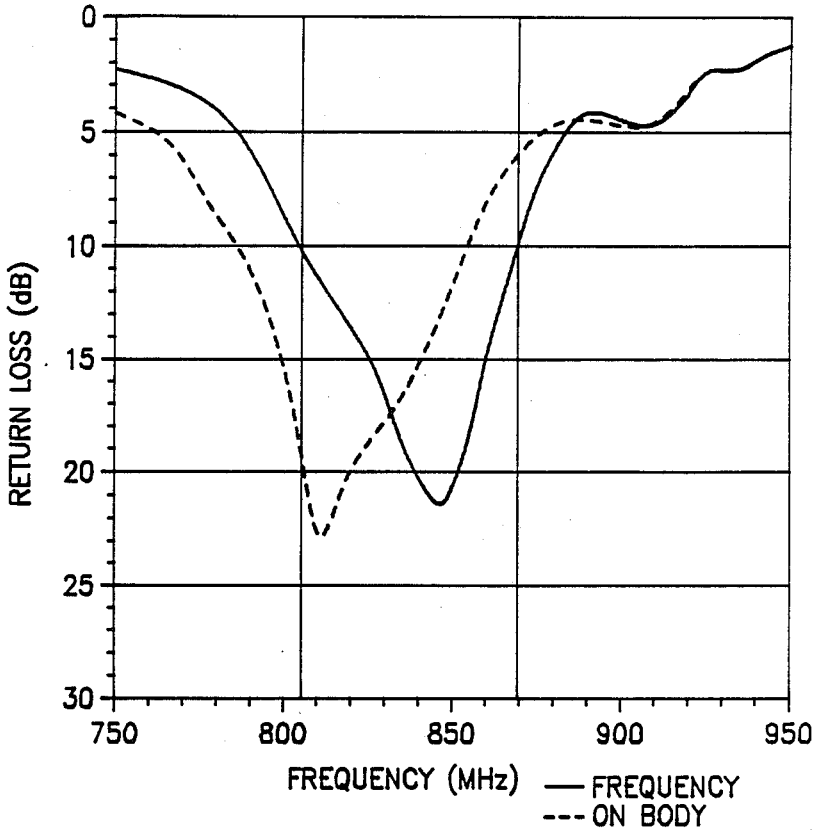
FIG. 4 is a plot of the return loss (impedance characteristics) of the antenna vs. frequency, for both free space and on the body.
Figure 5:
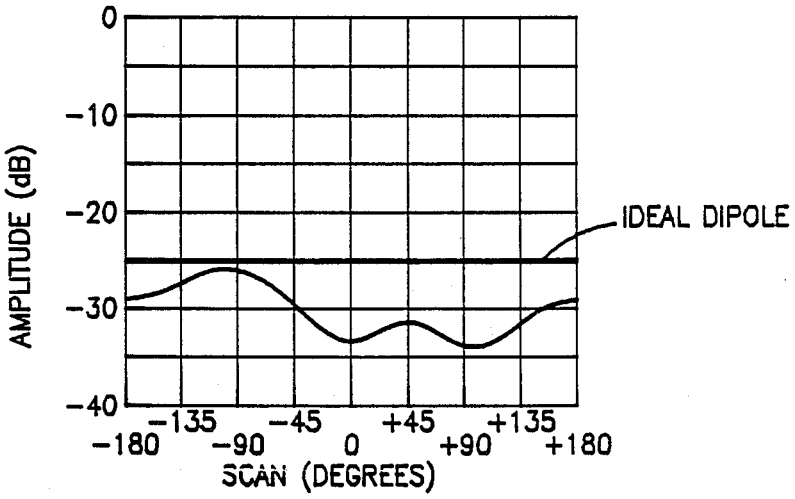
FIG. 5 is a rectangular plot of radiation versus orientation of the antenna of the present invention as compared to that of an ideal dipole.

The performance characteristics for the antenna as herein disclosed are depicted in FIGS. 4 and 5. FIG. 4 references the antenna impedance characteristics in terms of return loss in dB versus frequency in megahertz. With the antenna 12 designed to operate in the 806–870 mHz range, it will be readily apparent that the return loss as depicted at the high and low ends of the operating frequency range of the antenna is well within acceptable limits through out such range. This is so whether the antenna is operating while in close proximity to the user's body or is suspended in free space.

FIG. 5 represents a rectangular plot of radiation versus orientation. The axis of rotation is essentially vertical as shown by the arrow 50 in FIG. 1 with the radiation being orthogonal thereto, or in the horizontal plane. The graph in FIG. 5, in plotting amplitude in dB versus the scan in degrees illustrates that the antenna 12 is in fact highly efficient and is but some 4 dB below-an ideal dipole as depicted in FIG. 5. This figure was obtained by pattern integration of the vertically polarized energy radiated on the horizon with the antenna in its standard orientation. It will be understood by those skilled in the art that this represents very good performance characteristics considering the size of the antenna involved which is on the order of 1/20 of a wave length high. In point of fact, it is within 3 dB of the conventional portable whip end antenna referred to previously in the background section hereof, which is on the order of 20 times the height of the antenna of the present invention.

Accordingly, what is claimed is:

1. A low-profile antenna structure operable within a given band of frequencies and especially suited for use with associated hand-held, portable electronic apparatus, comprising the combination:

a printed circuit board, and board having ribbon-like, wide band driven element of a quarter wave or more at the lower band edge and a parasitic element of like character essentially a quarter wave at the upper band edge, said elements being printed on one surface thereof in side-by-side, close coupling, parallel relation;

a feed point at one end of said driven element;

a ground point at one end of said parasitic element adjacent said one end of said driven element; and a conductive strip printed on the other side of said printed circuit board and positioned across the free ends of said driven and parasitic elements to enhance the coupling therebetween.

2. A low-profile antenna in accordance with claim 1 wherein the frequency of operation is in the 806 to 870 mHz range with the driven element being approximately 3.0 inches in length and the parasitic element being approximately 2.64 inches in length.

3. A low-profile antenna in accordance with claim 2 wherein the spacing between the driven and parasitic elements is 0.02 inches or less along their entire length.

4. A low-profile antenna in accordance with claim 3 wherein the width of the driven and parasitic elements is 0.5 inches or more.

5. A low-profile antenna in accordance with claim 1 wherein the conductive strip on the other side of said printed circuit board includes a centrally located notch therein to effect restriction of the coupling currents in said driven and parasitic elements to the extreme end portions thereof.

6. A low-profile antenna in accordance with claim 1 wherein said feed point is adapted to be connected to a 50 ohm feed cable.

7. Portable, hand-held electronic apparatus having a chassis with a low-profile antenna structure, operable within a given band of frequencies mounted thereon, comprising combination:

a printed circuit board, said board having ribbon-like, wide band driven element of quarter wave or more at the low band edge and a parasitic element of like character essentially a quarter wave at the upper band edge, said element being printed on one surface thereof in a side-by-side, close coupling, parallel relation;

said printed circuit board being mounted on the chassis by non-conductive mounting posts and spaced a given distance from, and in a parallel relation to, the chassis;

a feed point at one end of said driven element adapted for connection to a feed cable;

a ground point at one end of said parasitic element adjacent said one end of said driven element; and a conductive strip printed on the other side of said printed circuit board and positioned across the free ends of said driven and parasitic elements to enhance the coupling therebetween.

8. Portable, hand-held electronic apparatus with a low-profile antenna in accordance with claim 7 wherein the frequency of operation is in the 806 to 870 mHz range with the driven element being approximately 3.0 inches in length and the parasitic element being approximately 2.64 inches in length.

9. Portable, hand-held electronic apparatus with a low-profile antenna in accordance with claim 8 wherein the spacing between the driven and parasitic elements is 0.02 inches or less along their entire length.

10. Portable, hand-held electronic apparatus with a low-profile antenna in accordance with claim 7 wherein the width of the driven and parasitic elements is 0.5 inches or more.

11. Portable, hand-held electronic apparatus with a low-profile antenna in accordance with claim 7 wherein the conductive strip on the other side of said printed circuit board includes a centrally located notch therein to effectively restrict the coupling currents in said driven and parasitic elements to the extreme end portions thereof.

12. Portable, hand-held electronic apparatus with a low-profile antenna in accordance with claim 7 wherein said feed point is adapted to be connected to a 50 ohm feed cable.

13. Portable, hand-held electronic apparatus with a low-profile antenna in accordance with claim 7 wherein said mounting posts are constructed of a dielectric material.

14. Portable, hand-held electronic apparatus with a low-profile antenna in accordance with claim 7 wherein the spacing between said antenna and the electronic chassis is on the order of 1/30 of a wavelength.

* * * * *